US006326866B1

(12) United States Patent
Sasaki et al.

(10) Patent No.: US 6,326,866 B1
(45) Date of Patent: Dec. 4, 2001

(54) BANDPASS FILTER, DUPLEXER, HIGH-FREQUENCY MODULE AND COMMUNICATIONS DEVICE

(75) Inventors: Yutaka Sasaki, Nagaokakyo; Hiroaki Tanaka, Osaka-fu, both of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/256,168

(22) Filed: Feb. 23, 1999

(30) Foreign Application Priority Data

| | | |
|---|---|---|
| Feb. 24, 1998 | (JP) | 10-041956 |
| Mar. 12, 1998 | (JP) | 10-061458 |
| Dec. 28, 1998 | (JP) | 10-373496 |

(51) Int. Cl.[7] ..... H01P 1/20; H01P 5/12
(52) U.S. Cl. ..... 333/203; 333/204; 333/134
(58) Field of Search ..... 333/203, 204, 333/134

(56) References Cited

U.S. PATENT DOCUMENTS

| | | | | |
|---|---|---|---|---|
| 4,168,479 | | 9/1979 | Rubin | 333/126 |
| 5,004,992 | * | 4/1991 | Grieco et al. | 333/202 |
| 5,376,908 | * | 12/1994 | Kawaguchi et al. | 333/203 |
| 5,977,847 | * | 11/1999 | Takahashi | 333/204 |
| 5,986,525 | * | 11/1999 | Sasaki et al. | 333/203 |

OTHER PUBLICATIONS

Patent Abstracts of Japan, vol. 7, No. 182 (E192), Aug. 11, 1983 & JP 58 085601 A (Nippon Denki KK), May 23, 1983, abstract.

Patent Abstracts of Japan, vol. 1, No. 156 (E–74), Dec. 13, 1977 & JP 52 099750 A (Toshiba Corp), Aug. 22, 1977, abstract.

Patent Abstracts of Japan, vol. 11, No. 367 (E–561), Nov. 28, 1977 & JP 62 140501 A (NEC Corp), Jun. 24, 1987, abstract.

Patent Abstracts of Japan, vol. 7, No. 76 (E–561), Nov. 28, 1987 & JP 58 005001 A (Matsushita Denki Sangyo KK), Jan. 12, 1983, abstract.

Patent Abstracts of Japan, vol. 15, No. 498 (E–1146), Dec. 17, 1991 & JP 03 218102 A (Fujitsu General Ltd) Sep. 25, 1991, abstract.

* cited by examiner

*Primary Examiner*—Benny Lee
*Assistant Examiner*—Patricia Nguyen
(74) *Attorney, Agent, or Firm*—Ostrolenk, Faber, Gerb & Soffen, LLP

(57) ABSTRACT

A bandpass filter is capable of forming attenuation extremes on both sides of a passband. Multiple microstrip line resonators, one end of each being an open terminal and the other end connecting to a ground electrode, are provided in a row, and the inner microstrip line resonators are bent in a C-shape so that the open terminals of the outer microstrip line resonators project further than the inner microstrip line resonators. The line of sight between the open terminals of the microstrip line resonators is improved and capacitance is formed there, so that attenuation extremes can be formed on both sides of the passband, and the amount of attenuation can be increased.

23 Claims, 7 Drawing Sheets

BANDPASS FILTER, DUPLEXER, HIGH-FREQUENCY MODULE AND COMMUNICATIONS DEVICE

BACKGROUND OF THE INVENTION

1. Field of the Invention

The present invention relates to a bandpass filter, a duplexer using the filter, a high-frequency module using these, and a communications device using the module, more particularly to a bandpass filter used in the rf stage of a microwave band mobile communications apparatus, a duplexer using the filter, a high-frequency module using these, and a communications device using the module.

2. Description of the Related Art

Recently, mobile communications apparatus, especially portable telephones, are being made small-scale and use higher frequencies, and consequently there is increasing demand for a small-scale and narrow-band bandpass filter and duplexer, used in the rf stage and the like of such apparatus.

FIG. 10 shows an electrode pattern of a conventional combine bandpass filter. In FIG. 10, a bandpass filter 1 comprises a ground electrode 2, microstrip line resonators 3, 4, 5 and 6, which are distributed constant line resonators having length of roughly one quarter of the wavelength of the intended frequency, one end of each being an open terminal and the other end connecting to the ground terminal 2 to form a ground terminal, an input terminal 7 and an output terminal 8. The input terminal 7 and the output terminal 8 are respectively connected to the microstrip line resonators 3 and 6. Then, the above components are provided on part of one main face of, for instance, a printed substrate, which has a ground terminal provided roughly completely over its other main face, so as to form a bandpass filter. Or, as shown in FIG. 11, the above components are provided on a main face of a small dielectric substrate 9, which has a ground terminal provided roughly completely over its other main face, so as to be used as a single chip component. In FIG. 11, like members to FIG. 10 are designated by like reference characters.

In the bandpass filter 1 of the above constitution, a signal input from the input terminal 7 to the microstrip line resonator 3 is input to a filter circuit comprising the microstrip line resonators 3, 4, 5 and 6. The microstrip line resonators 3, 4, 5 and 6 resonate at their intended frequencies, and in addition, they are coupled together by a particularly strong magnetic field generated near their ground terminals, thereby operating as a bandpass filter, allowing only signals close to their intended frequencies to pass and reflecting signals at other frequencies. Then, signals at the intended frequencies are output from the microstrip line resonator 6 to the output terminal 8.

FIG. 12 shows pass characteristics and reflection characteristics of the bandpass filter 1. In FIG. 12, characteristics a represents insertion loss, characteristic b represents reflection loss, and there is a passband of approximately 400 MHz around 4 GHz.

However, as shown in FIG. 12, in the above bandpass filter 1, the insertion loss characteristic a has an attenuation extreme pl only on the high side. Generally, in a bandpass filter, a large amount of attenuation of insertion loss in regions other than the passband is desirable, but in a normal combine filter either, only one such attenuation extreme is formed or absolutely no attenuation extreme is formed, and consequently it is not possible to obtain a sufficient amount of attenuation in the attenuation regions, which include frequency bands on both sides of the passband. More specifically, as shown in FIG. 12, insertion loss of not more than −40 dB (target value AL) at 3.4 GHz is needed on the low side, and insertion loss of not more than −40 dB (target value AH) at 4.6 GHz is needed on the high side, but in fact the insertion loss in each case is only −22 dB and −23 dB respectively.

SUMMARY OF THE INVENTION

Accordingly, it is an object of the present invention to solve the problems described above by providing a bandpass filter wherein attenuation extremes can be formed on both sides of the passband, a duplexer using the bandpass filter, a high-frequency module using these, and a communications device using the high-frequency module.

In order to achieve the above-mentioned objects, the bandpass filter of the present invention provides a combine bandpass filter, comprising a plurality of distributed constant line resonators, one end of each being an open terminal and the other end a ground terminal, provided in a row, wherein the open terminals are disposed outline the distributed constant line resonators and project further than the inner distributed constant line resonators.

Furthermore, according to the bandpass filter of the present invention, the open terminals of the inner distributed constant line resonators are close together.

Furthermore, according to the bandpass filter of the present invention, a ground electrode is provided close to the open terminals of the distributed constant line resonators, and capacitance is formed between the open terminals of the distributed constant line resonators and the ground electrode.

Furthermore, according to a duplexer of the present invention, two of any of the bandpass filters described above are connected.

Furthermore, a high-frequency module of the present invention uses any one of the above bandpass filters or the duplexer.

Furthermore, a communications device of the present invention uses the above high-frequency module.

By such a constitution, the bandpass filter of the present invention is able to provide attenuation extremes on both sides of the passband.

Furthermore, the duplexer of the present invention can be made small-scale.

Furthermore, in the high-frequency module of the present invention, circuit constitution can easily be made small-scale and cost reduced.

Furthermore, the communications device of the present invention can be made small-scale and cost reduced.

DESCRIPTION OF THE PREFERRED EMBODIMENTS

Figure 1:
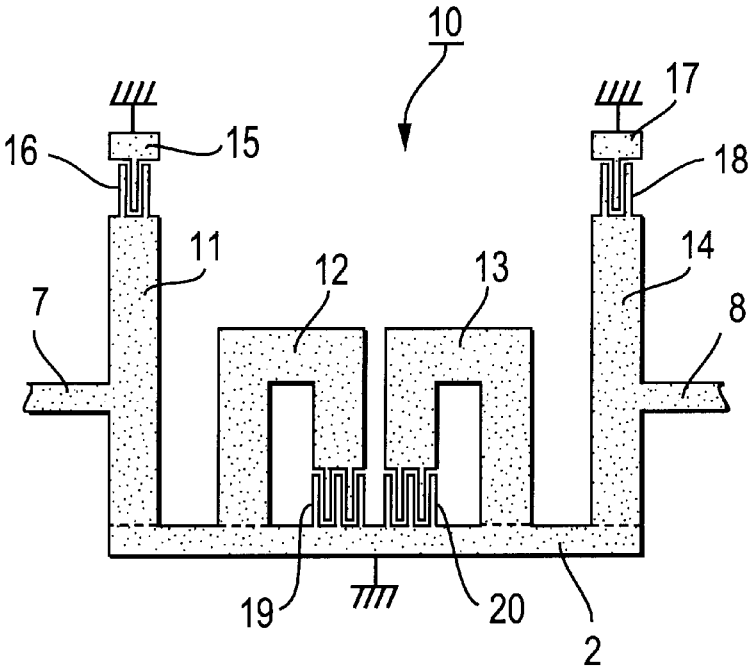
FIG. 1 is an electrode pattern of an embodiment of a bandpass filter of the present invention.
Figure 10:
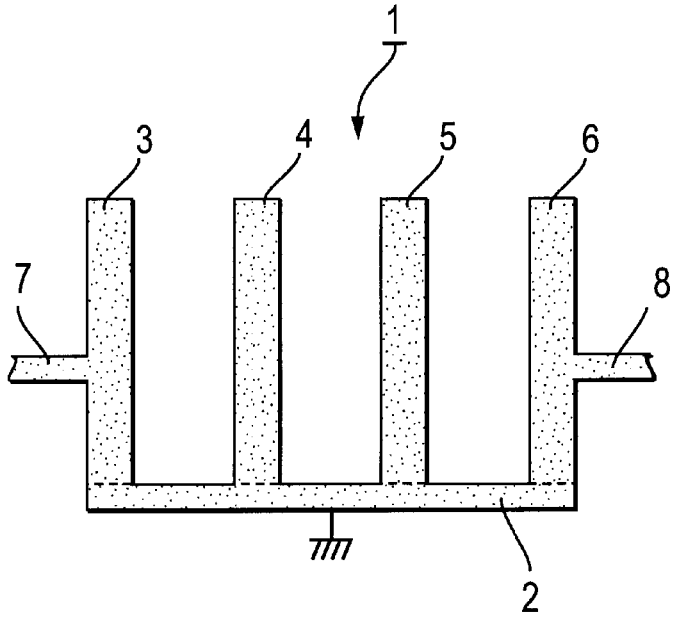
FIG. 10 PRIOR ART
FIG. 10 is a diagram showing an electrode pattern of a conventional bandpass filter.
Figure 11:
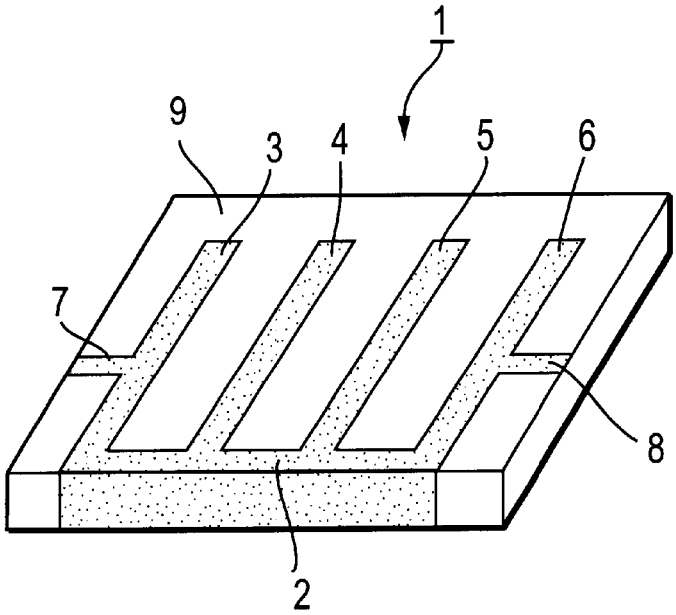
FIG. 11 PRIOR ART
FIG. 11 is a perspective view of the constitution of the bandpass filter of FIG. 10.
Figure 12:
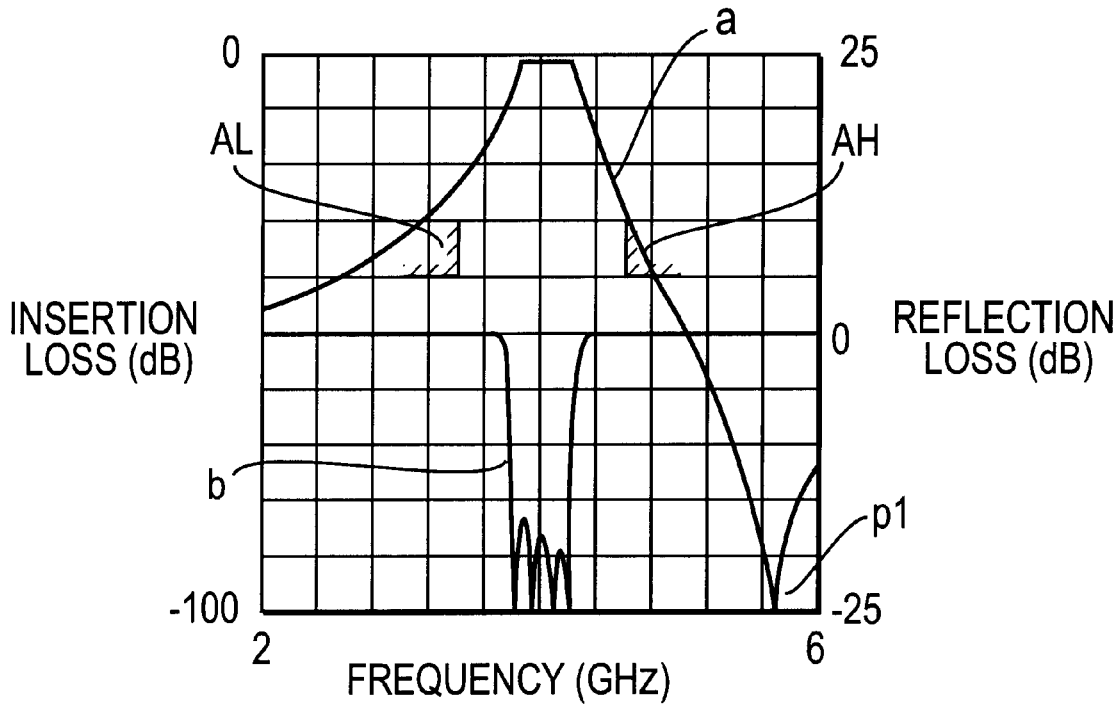
FIG. 12 PRIOR ART
FIG. 12 is a diagram showing pass characteristics and reflection characteristics of a conventional bandpass filter.

FIG. 1 shows an electrode pattern of an embodiment of the bandpass filter of the present invention. In FIG. 1, like and similar members to FIG. 10 are designated by like reference characters, and explanation of these is omitted.

Figure 2:
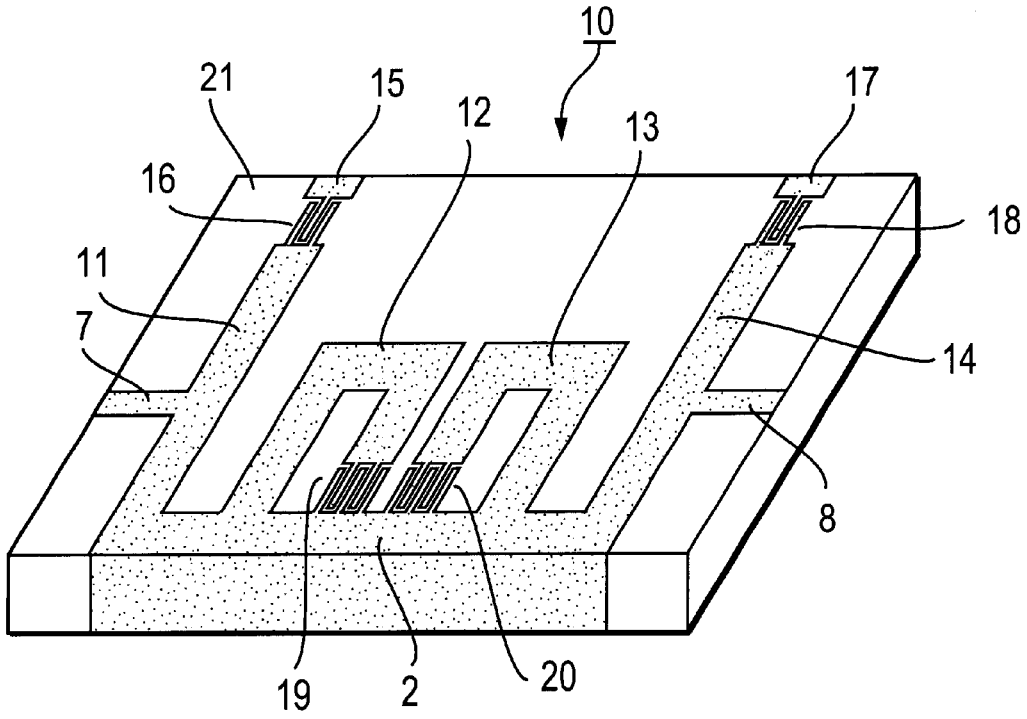
FIG. 2 is a perspective view of a constitution of the bandpass filter of FIG. 1.

In FIG. 1, a bandpass filter 10 comprises a ground electrode 2, microstrip line resonators 11, 12, 13 and 14, being distributed constant line resonators having length of roughly one quarter of the wavelength of the intended frequency, one end thereof being an open terminal and the other end connecting to the ground terminal 2 to form a ground terminal, an input terminal 7, an output terminal 8, ground electrodes 15 and 17, and pairs of comb-like electrode pairs 16, 18, 19 and 20. Here, the pairs of comb-like electrode 16 and 18 are provided between the open terminals of the outer microstrip line resonators 11 and 14 and the ground terminals 15 and 17 respectively, producing capacitance. Furthermore, the open terminals of the inner microstrip line resonators 12 and 13 bend toward each other in a C-shape, so that capacitance is formed therebetween. Moreover, the comb-like electrode pairs 19 and 20 are provided respectively between the open terminals of the microstrip line resonators 12 and 13 and the ground electrode 2, forming capacitance. Then, for instance, these components are provided on part of a main face of a printed substrate, having a ground terminal provided roughly completely over its other main face, thereby forming a signal processor; or, as shown in FIG. 2, they are provided on a main face of a small dielectric substrate 21, having a ground terminal provided roughly completely over its other main face, and used as a single chip component. In FIG. 2, like members to those shown in FIG. 1 are designated by like reference characters.

In the bandpass filter 10 of the constitution described above, capacitance at the open terminals of the microstrip line resonators 11, 12, 13 and 14 lowers the resonant frequencies of these resonators, thereby making it possible to reduce the practical lengths of the microstrip line resonators 11, 12, 13 and 14 to less than a quarter of their intended frequencies, and consequently enabling the bandpass filter 10 to be made small-scale.

Furthermore, since the inner microstrip line resonators 12 and 13 bend in a C-shape, the open terminals of the outer microstrip line resonators 11 and 14 project further than the inner microstrip line resonators 12 and 13. As a consequence, there is nothing to obstruct the space between the open terminals of the outer microstrip line resonators 11 and 14, improving their mutual line of sight. As a result, direct capacitance is formed between the open terminals of the outer microstrip line resonators 11 and 14.

Figure 3:
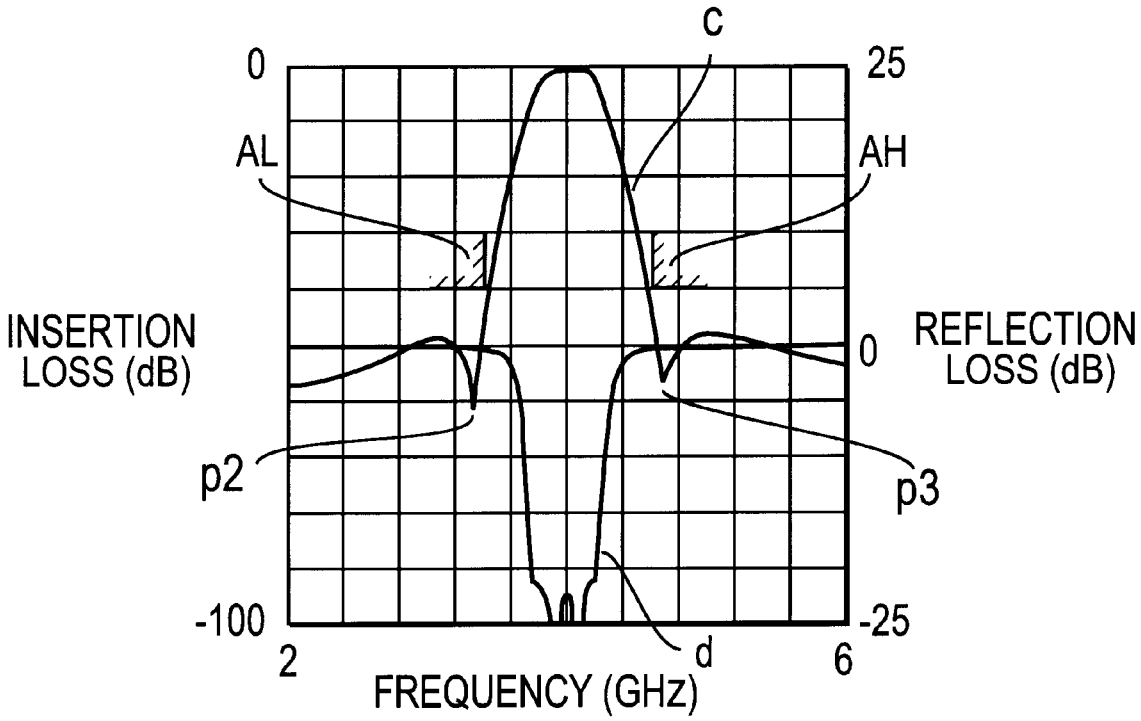
FIG. 3 is a diagram showing pass characteristics and reflection characteristics of the bandpass filter of FIG. 1.

FIG. 3 shows pass characteristics and reflection characteristics of the bandpass filter 10 of the above constitution. In FIG. 3, characteristic c represents insertion loss, characteristic d represents reflection loss. It can be understood from insertion loss characteristic c that, as in the conventional technology, there is a passband of approximately 400 MHz around 4 GHz. Consequently, the amount of attenuation in the attenuation regions on both sides of the passband is better than in the conventional case. More specifically, on the low side, insertion loss is −43 dB at 3.4 GHz, and on the high side, insertion loss is −44 dB at 6 GHz, these both being below −40 dB and therefore fulfilling the target values AL and AH.

Thus, when the inner microstrip line resonators 12 and 13 of the bandpass filter 10 are bent in a C-shape so that the open terminals of the microstrip line resonators 11 and 13 project further than the inner microstrip line resonators 12 and 13, direct capacitance can be formed between the open terminals of the microstrip line resonators 11 and 14, whereby attenuation extremes can be achieved on both sides of the passband and the amount of attenuation can be increased.

Furthermore, since the open terminal of the inner microstrip line resonators 12 and 13, which bend in a C-shape, are provided close to each other, capacitance can be formed between them, whereby attenuation extremes can be obtained on both sides of the passband and the amount of attenuation can be increased.

Figure 4:
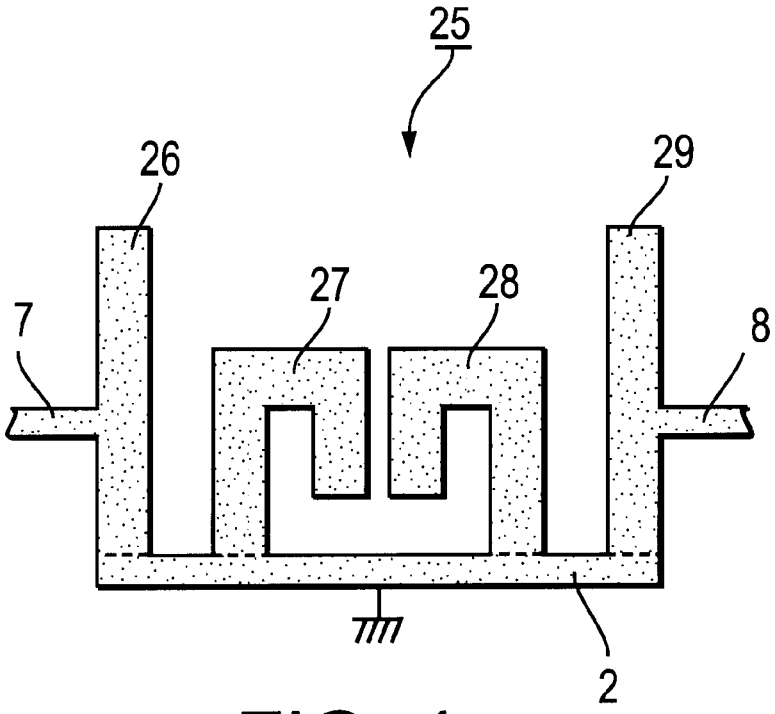
FIG. 4 is a diagram showing an electrode pattern of another embodiment of the bandpass filter of the present invention.
Figure 5:
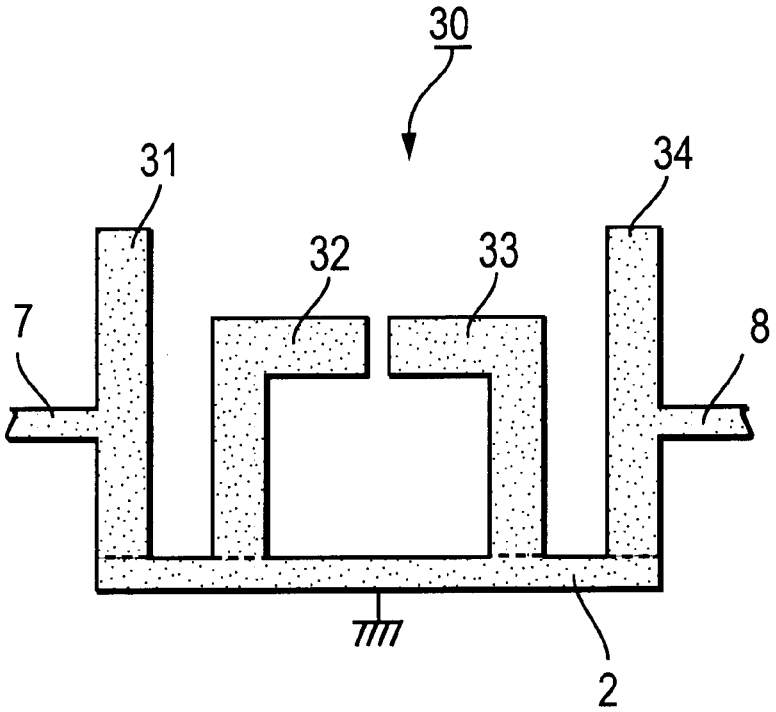
FIG. 5 is a diagram showing an electrode pattern of yet another embodiment of the bandpass filter of the present invention.
Figure 6:
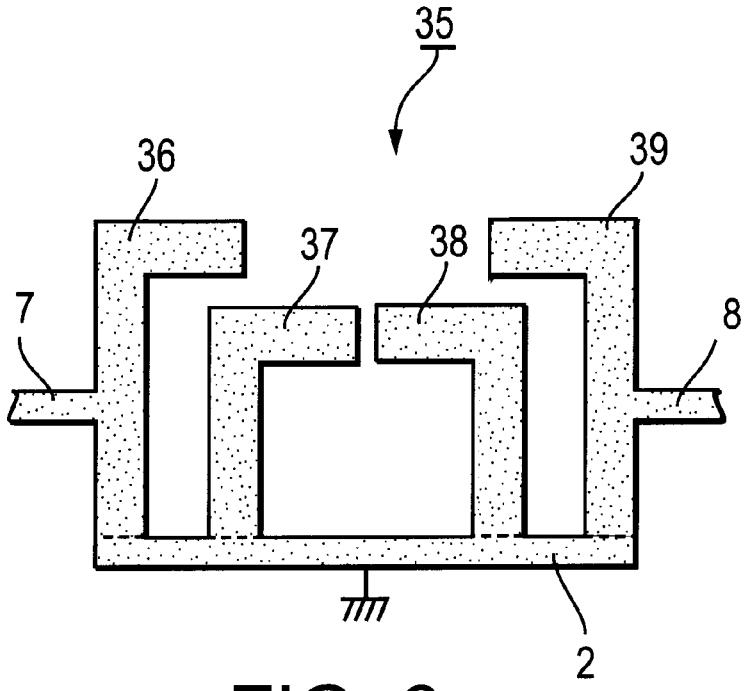
FIG. 6 is a diagram showing an electrode pattern of yet another embodiment of the bandpass filter of the present invention.

FIGS. 4 to 6 show electrode patterns of other embodiments of the bandpass filter of the present invention. In FIGS. 4 to 6, like members to those in FIG. 1 are designated by like reference characters, and further explanation of them is omitted.

Firstly, in FIG. 4, a bandpass filter 25 comprises a ground electrode 2, microstrip line resonators 26, 27, 28 and 29, being distributed constant line resonators having length of roughly one quarter of the wavelength of the intended frequency, one end thereof being an open terminal and the other end connecting to the ground terminal 2 to form a ground terminal, an input terminal 7, and an output terminal 8. The bandpass filter 25 differs from the bandpass filter 10 of FIG. 1 only in respect of the fact that no comb-like electrodes are provided to create capacitance between the open terminals of the microstrip line resonators 26, 27, 28 and 29 and the ground electrode.

In the bandpass filter 25 of such a constitution, exactly the same action and effect can be obtained as the bandpass filter 10, with the exception of the small-scaling made possible by capacitance between the open terminals of the microstrip line resonators and the ground electrode.

Furthermore, in FIG. 5, a bandpass filter 30 comprises a ground electrode 2, microstrip line resonators 31, 32, 33 and 34, being distributed constant line resonators having length of roughly one quarter of the wavelength of the intended frequency, one end thereof being an open terminal and the other end connecting to the ground terminal 2 to form a ground terminal, an input terminal 7, an output terminal 8. The bandpass filter 30 differs from the bandpass filter 25 of FIG. 4 only in that the inner microstrip line resonators 32 and 33 are provided in an L-shape, their open terminals being provided close together so that capacitance is formed in between.

In the bandpass filter 30 of this constitution, the open terminals of the outer microstrip line resonators 31 and 34 project further than the open terminals of the inner microstrip line resonators 32 and 33, and consequently exactly the same action and effect can be obtained as the bandpass filter 10, with the exception of the small-scaling made possible by capacitance formed between the open terminals of the microstrip line resonators and the ground electrode.

Furthermore, in FIG. 6, a bandpass filter 35 comprises a ground electrode 2, microstrip line resonators 36, 37, 38 and 39, these being distributed constant line resonators having length of roughly one quarter of the wavelength of the intended frequency, one end thereof being an open terminal and the other end connecting to the ground terminal 2 to form a ground terminal, an input terminal 7, an output terminal 8. The bandpass filter 35 differs from the bandpass filter 30 of FIG. 5 only in that the outer microstrip line resonators 36 and 39 are also provided in an L-shape, so that their open terminals are facing each other.

In the bandpass filter 35 of such a constitution, not only do the open terminals of the outer microstrip line resonators 36 and 39 project further than the open terminals of the inner microstrip line resonators 37 and 38, but also, even greater capacitance can be formed between the open terminals of the outer microstrip line resonators 36 and 39, and, in addition to the same action and effects of the bandpass filter 30, it is easy to create attenuation extremes on both sides of the passband.

In each of the embodiments described above, the bandpass filter used four microstrip line resonators comprising distributed constant line resonators, but the number of microstrip line resonators is not restricted to four, and any constitution is acceptable which uses three or more microstrip line resonators. Furthermore, in each of the embodiments described above, microstrip line resonators were used as the distributed constant line resonators, but other distributed constant line resonators, such as strip line resonators in a triplate structure, may acceptably be used.

Figure 7:
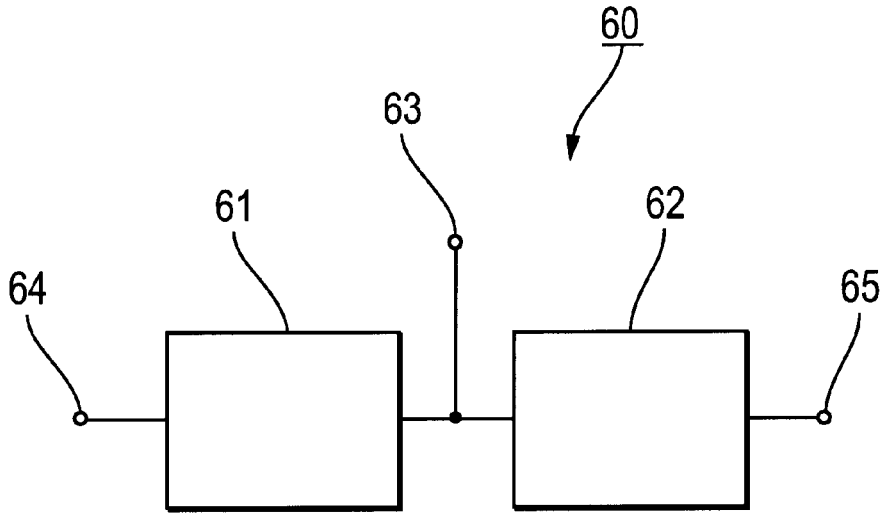
FIG. 7 is a block diagram showing an embodiment of a duplexer of the present invention.
Figure 8:
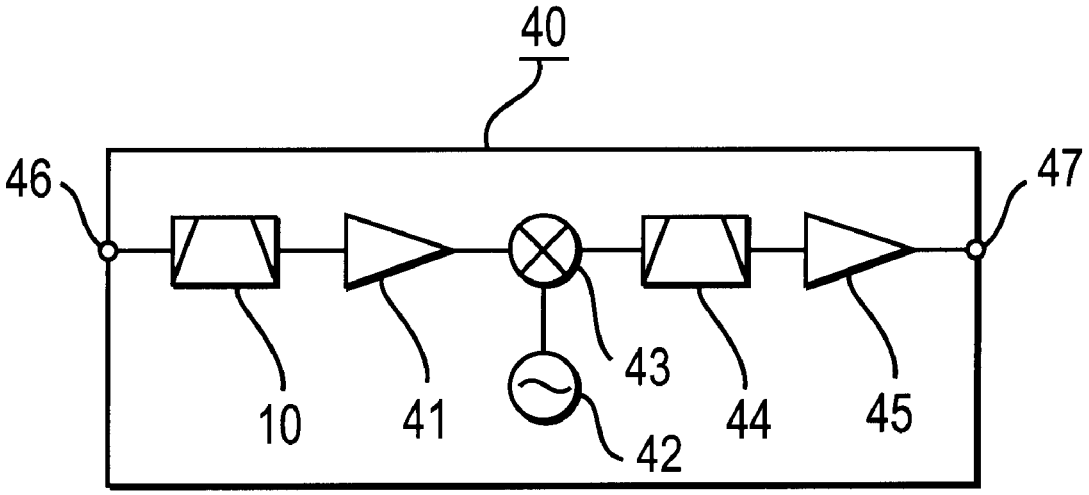
FIG. 8 is a block diagram showing an embodiment of a high-frequency module of the present invention.

FIG. 7 shows a block diagram of an embodiment of a duplexer using the bandpass filter of the present invention. In FIG. 8, a duplexer 60 comprises two bandpass filters 61 and 62 of the present invention, which have different frequency bands, an antenna 63, connected to one terminal of each bandpass filter, the other terminal of the bandpass filter 61 being a transmission side terminal 64, and the other terminal of the bandpass filter 62 being a reception side terminal 65.

Using the duplexer of such a constitution, a communications device is formed when the transmission side terminal 64 is connected to a transmitter, and the reception side terminal 65 is connected to a receiver, and, when transmitting and receiving using a common external antenna, a transmission signal is prevented from entering the receiving circuit, and a receive signal is prevented from entering the transmitting circuit. Particularly, by using bandpass filters of the present invention, it is possible to increase the amount of attenuation in the passband of the other's bandpass filter, and to obtain sufficient isolation between the transmission terminal 64 and the reception terminal 65.

FIG. 8 shows an embodiment of a high-frequency module using the duplexer of the present invention. In FIG. 8, the high-frequency module 40 is a downconverter comprising a bandpass filter 10 of the present invention as an rf filter, an rf amplifier 41, a station oscillator 42, a mixer 43, an if filter 44, an if amplifier 45, an input terminal 46 and an output terminal 47. Here, the input terminal 46 is connected sequentially via the bandpass filter 10 and the amplifier 41 to the mixer 43. Furthermore, the station oscillator 42 also connects to the mixer 43. Then, the output of the mixer 43 connects sequentially via the if filter 44 and the if amplifier 44 to the output terminal 47.

The high-frequency module 40 of this constitution uses the bandpass filter 10 of the present invention, and so is able to achieve an increased amount of attenuation in the attenuation regions, and consequently there is no need to use components such as a notch filter to compensate for an insufficient amount of attenuation. Furthermore, it is possible to simplify an input adjusting circuit of the rf amplifier and the like connected in the latter stage. As a result, the high-frequency module 40 can be made small-scale and cost can be reduced.

Here, the high-frequency module 40 of FIG. 8 used the bandpass filter 10, but a high-frequency module can be formed using any of the bandpass filters 25, 30 and 35 and the duplexer 60 shown in FIGS. 4 to 7, achieving the same effects.

Figure 9:
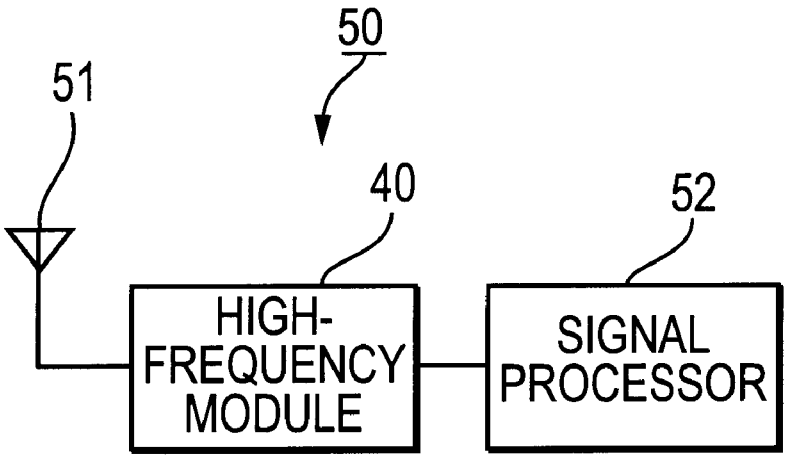
FIG. 9 is a block diagram showing an embodiment of a communications device of the present invention.

FIG. 9 shows an embodiment of a communications device using the high-frequency module of the present invention. In FIG. 9, the communications device 50 comprises a high-frequency module 40, an antenna 51, and a signal processing circuit 52. Here, the antenna 51 connects to the high-frequency module 40, and the high-frequency module 40 connects to the signal processing circuit 52.

The communications device 50 of this constitution uses the high-frequency module 40 of the present invention, and consequently can be made small-scale and cost can be reduced.

According to the bandpass filter of the present invention, multiple distributed constant line resonators, one end of each being an open terminal and the other end a ground terminal, are provided in a row, and the outer distributed constant line resonators are projected further than the inner distributed constant line resonators, so that attenuation extremes can be formed on both sides of the passband and the amount of attenuation in the attenuation regions can be increased. Furthermore, by forming capacitance between the open terminals of the inner distributed constant line resonators, attenuation extremes can be formed on both sides of the passband and the amount of attenuation in the attenuation regions can be increased. Moreover, by forming capacitance between the open terminals of the distributed constant line resonators and the ground electrode, the bandpass filter can be made small-scale and cost reduced.

Furthermore, the duplexer of the present invention can be made small-scale by using the bandpass filter of the present invention, and sufficient isolation can be obtained between the transmission side terminal and the reception side terminal.

Furthermore, the high-frequency module of the present invention uses the bandpass filter of the present invention, and consequently can be made small-scale and cost can be reduced.

Furthermore, the communications device of the present invention uses the high-frequency module of the present invention, and consequently can be made small-scale and cost can be reduced.

What is claimed is:

1. A comb-line bandpass filter comprising:

a plurality of distributed constant line resonators, one end of each resonator being an open terminal and another end a ground terminal connected to a ground electrode, provided in a row and extending along a surface;

wherein said open terminals of outer distributed constant line resonators project further from the ground electrode along said surface than an inner distributed constant line resonator, thereby providing a line-of-sight between the outer resonators so as to form a capacitance and provide attenuation at both sides of a passband of the filter; and wherein said inner distributed constant line resonator has a bent configuration.

2. A bandpass filter according to claim 1, wherein there are a plurality of said inner distributed constant line resonators, each having a respective bent configuration, and said open terminals of said inner distributed constant line resonators are close together, thereby forming a capacitance and providing attenuation at both sides of the passband of the filter.

3. A bandpass filter according to claim 1, wherein said open terminals of said distributed constant line resonators are ground via respective capacitances.

4. A duplexer, comprising two bandpass filters of claim 1, each having two input/output terminals, one input/output terminal of each of said two bandpass filters being connected together.

5. A high-frequency module comprising a high-frequency circuit, connected to the bandpass filter of claim 1.

6. A communications device comprising the high-frequency module according to claim 5, connected to a high-frequency circuit including at least one of a transmitting circuit and a receiving circuit.

7. A high-frequency module comprising a high-frequency circuit, connected to the duplexer of claim 4.

8. A bandpass filter according to claim 1, wherein said inner distributed constant line resonator has a U-shaped configuration.

9. A bandpass filter according to claim 2, wherein each of said inner distributed constant line resonators has a respective U-shaped configuration.

10. A bandpass filter according to claim 9, wherein said open terminals of said inner distributed constant line resonators are each grounded to said ground electrode via respective capacitances.

11. A bandpass filter according to claim 3, wherein said open terminals of said inner distributed constant line resonators are each grounded to said ground electrode via respective capacitances.

12. A bandpass filter according to claim 2, wherein said open terminals of said inner distributed constant line resonators are each grounded to said ground electrode via respective capacitances.

13. A comb-line bandpass filter comprising:

a plurality of distributed constant line resonators including a pair of outer distributed constant line resonators and at least one inner distributed constant line resonator, one end of each resonator being an open terminal and another end a ground terminal connected to a ground electrode, said resonators being provided in a row and extending along a surface;

wherein said resonators project away from said ground electrode along said surface; and wherein said at least one inner distributed constant line resonator has a bent configuration;

wherein said open terminals of said distributed constant line resonators are grounded via respective capacitances.

14. A bandpass filter according to claim 13, wherein said open terminal of said at least one inner distributed constant line resonator is grounded to said ground electrode via a respective capacitance.

15. A bandpass filter according to claim 13, wherein said at least one inner distributed constant line resonator has a U-shaped configuration.

16. A comb-line bandpass filter comprising:

a plurality of distributed constant line resonators including a pair of outer distributed constant line resonators and at least one inner distributed constant line resonator, one end of each resonator being an open terminal and another end a ground terminal connected to a ground electrode, said resonators being provided in a row and extending along a surface;

wherein said resonators project away from said ground electrode along said surface; and wherein said at least one inner distributed constant line resonator has a bent configuration;

wherein there are a plurality of said inner distributed constant line resonators, each having a respective bent configuration, and said open terminals of said inner distributed constant line resonators are close together, thereby forming a capacitance and providing attenuation at both sides of the passband of the filter.

17. A bandpass filter according to claim 16, wherein each of said inner distributed constant line resonators has a respective U-shaped configuration.

18. A bandpass filter according to claim 17, wherein said open terminals of said inner distributed constant line resonators are each grounded to said ground electrode via respective capacitances.

19. A bandpass filter according to claim 16, wherein said open terminals of said inner distributed constant line resonators are each grounded to said ground electrode via respective capacitances.

20. A duplexer, comprising two bandpass filters according to one of claims 13 and 16, each bandpass filter having two input/output terminals, one input/output terminal of each of said two bandpass filters being connected together.

21. A high-frequency module comprising a high-frequency circuit, connected to the duplexer of claim 20.

22. A high-frequency module comprising a high-frequency circuit, connected to the bandpass filter of one of claims 13 and 16.

23. A communications device comprising the high-frequency module according to claim 22, connected to a high-frequency circuit including at least one of a transmitting circuit and a receiving circuit.

* * * * *